US005243825A

United States Patent [19]

Lin

[11] Patent Number: 5,243,825

[45] Date of Patent: Sep. 14, 1993

[54] MULTI-PURPOSE ENGINE-DRIVEN HEAT PUMP SYSTEM

[75] Inventor: Jian-Yuan Lin, Hsinchu, Taiwan

[73] Assignee: Industrial Technology Research Institute, Taiwan

[21] Appl. No.: 878,856

[22] Filed: May 5, 1992

[51] Int. Cl.[5] ..... F25B 27/02

[52] U.S. Cl. ..... 62/238.7; 62/323.1; 62/324.1; 237/2 B

[58] Field of Search ..... 62/238.7, 323.1, 324.1, 62/160; 237/2 B

[56] References Cited

U.S. PATENT DOCUMENTS

| | | | |
|---|---|---|---|
| 4,098,092 | 7/1978 | Singh | 62/324.1 X |
| 4,646,537 | 3/1987 | Crawford | 62/238.7 X |
| 4,697,434 | 10/1987 | Yuyama | 62/238.7 |
| 4,938,032 | 7/1990 | Mudford | 62/238.7 X |

*Primary Examiner*—William E. Tapolcai
*Attorney, Agent, or Firm*—Andrus, Sceales, Starke & Sawall

[57] ABSTRACT

A multi-purpose engine-driven heat pump system which used solenoid valves, 3-way valves and 4-way valves to control the circulation path of coolant and water to perform various air-conditioning functions as follows: the house-cooling function only, a combination of the house-cooling function and the hot water generating function, the house-heating function only, a combination of the house-heating function and the hot water generating function, a combination of the house-heating function and the ice water generating function, the defumidifying function only, a combination of the dehumidifying function and the hot water generating function, the defrosting function only, and a combination of the ice water generating function and the hot water generating function.

9 Claims, 7 Drawing Sheets

MULTI-PURPOSE ENGINE-DRIVEN HEAT PUMP SYSTEM

FIELD OF THE INVENTION

The present invention relates to a heat pump system, especially to a multi-purpose engine-driven heat pump system for air-conditioning.

BACKGROUND OF THE INVENTION

Recently, because of the prosperity of various industries and businesses, the demand for electric power has been increasing. Moreover, rises in the standard of living and changes in the lifestyle are leading to a shortage of power sources. The shortage can be dealt with by developing new power sources or conserving electric power. Nevertheless, to develop a new power source is a long-term task. On the other hand, exploiting other energy options is easily accomplished within a short time. Among these options, one is to replace electric power with a non-electric power. For instance, an air-conditioner is driven by a gas-powered device instead of an electric-powered device. This can reduce peak electric power load. Meanwhile, the saved electric power can be used to further reduce the power consumed by other devices. Such versatile use of various energy sources can result in a substantial saving of energy. It is also helpful for balanced management of overall energy resource. To save energy means to efficiently utilize it. Among all kinds of power consumed in various applications, the growth rate of the electric power consumed by air-conditioners is the most rapid. It is also the major cause of power shortages. However, to drive the air-conditioner by other energy sources except electric power is one of the versatile applications of energy. Especially, one of the most potential air-conditioning equipments is a gas-powered engine-driven heat pump. The gas-powered engine-driven heat pump has the advantage of the efficient utilization of energy sources.

SUMMARY OF THE INVENTION

The major object of the present invention is to provide a house-heating apparatus.

Another object of the present invention is to provide a house-cooling apparatus.

A further object of the present invention is to provide a dehumidifying apparatus.

A still further object of the present invention is to provide a defrosting apparatus.

An additional object of the present invention is to provide a hot water generating apparatus.

One more additional object of the present invention is to provide an ice water generating apparatus.

The above objects are fulfilled by the following engine-driven heat pump system which comprises:

a first heat exchanger, which is disposed outdoors and capable of absorbing the heat dissipated from a heat pump;

a second heat exchanger, which is disposed outdoors and connected to the first heat exchanger by way of a first 3-way valve, being capable of performing a heat exchange between water and a coolant;

a third heat exchanger, which is disposed outdoors and connected to the first heat exchanger by way of the first 3-way valve, being capable of performing a heat exchange between the coolant and outdoor atmosphere;

a coolant tank, which is connected to the second heat exchanger and the third heat exchanger by way of a second 3-way valve;

a fourth heat exchanger, which is connected to the coolant tank through an expansion valve; and a compressor, which is connected to the first heat exchanger by way of a third 3-way valve, to the second heat exchanger and the third heat exchanger by way of a 4-way valve with the 4-way valve between the first 3-way valve and the compressor, and to the fourth heat exchanger by way of the 4-way valve. The coolant is circulated in the sequential order of the compressor, the first heat exchanger, the second heat exchanger or the third heat exchanger, the coolant tank, and the fourth heat exchanger whereby the house-cooling function and the dehumidifying function are performed at the fourth heat exchanger, and whereby, with the circulation order reversed between the 4-way valve and the fourth heat exchanger, the house-heating function is also performed at the fourth heat exchanger.

BRIEF DESCRIPTION OF THE FIGURES

The present invention will become more fully understood from the detailed description given hereinafter and the accompanying drawings which are given by way of illustration only, and thus are not limitative of the present invention and wherein.

DETAILED DESCRIPTION OF THE PREFERRED EMBODIMENT

Figure 1:
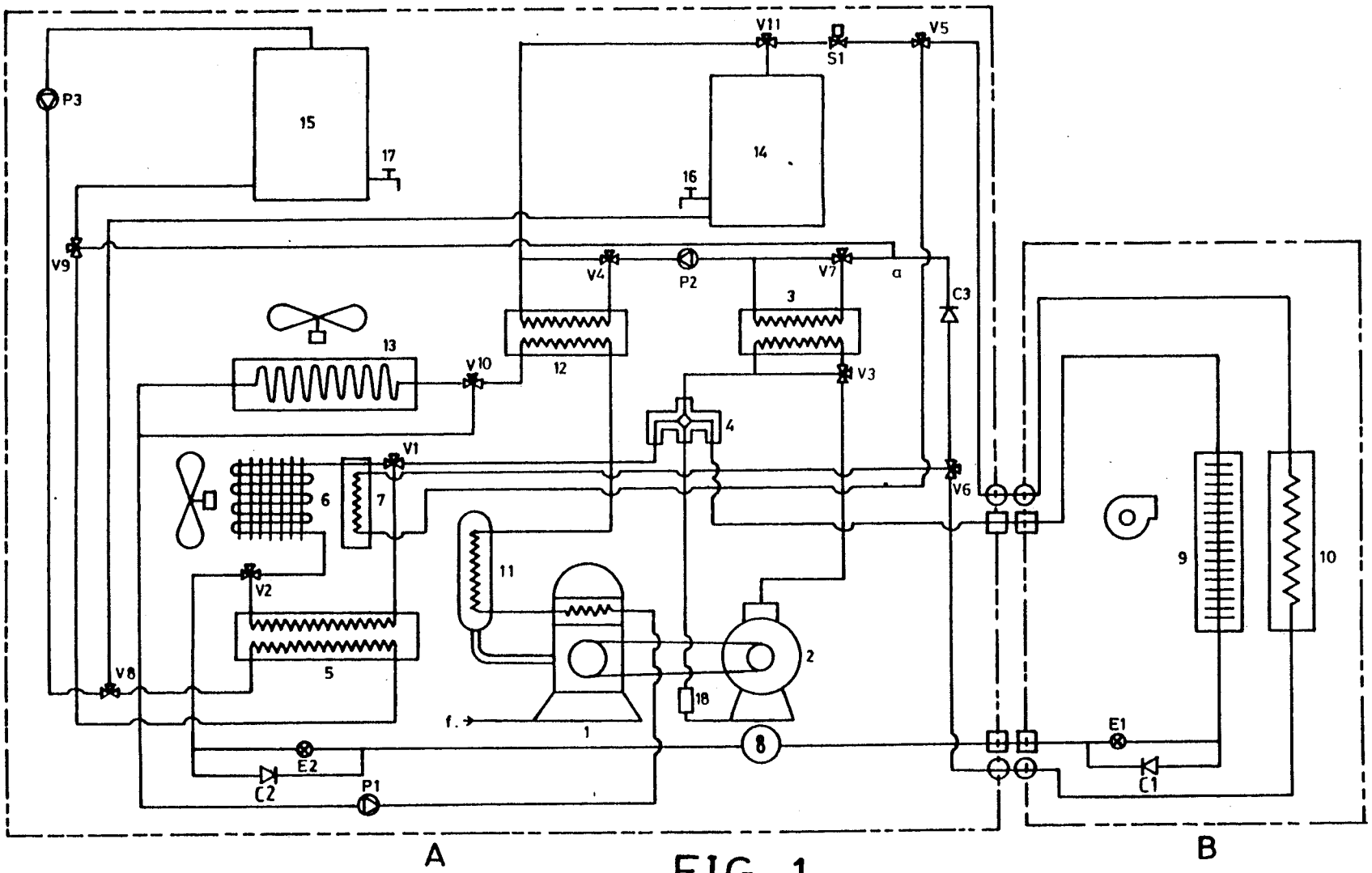
FIG. 1 is a schematic diagram of the multi-purpose engine-driven heat pump system.

With reference to FIG. 1, the multi-purpose engine-driven heat pump system according to the present invention comprises an engine, a compressor, several heat exchangers, several control valves, and a pair of tanks for ice water and hot water. By controlling the circulation path, the multi-purpose engine-driven heat pump system can perform the following functions:

a. house-cooling
b. house-heating
c. dehumidifying
d. defrosting
e. generating hot water
f. generating ice water The circulation path of the multi-purpose engine-driven heat pump system according to the present invention comprises a coolant circulation path, an engine cooling water circulation path, an ice water circulation path, and a hot water circulation path.

A coolant circulation path comprises a compressor 2, a first heat exchanger 3 for recovering the heat dissipated by the heat pumps, a four-way valve 4, a second heat exchanger 5 which is disposed outdoors (as shown inside the dashed-line block "A") to perform the heat exchange between the coolant and water, a third heat exchanger 6 which is disposed outdoors to perform the heat exchange between the coolant and air, a fourth heat exchanger 9 which is disposed indoors (as shown inside the dashed-line block "B") to perform the heat exchange between the coolant and water, an expansion valve E1, E2, a coolant tank 8, a solenoid valve S1, and several 3-way valves.

An engine cooling water circulation path comprises an engine 1, an eighth heat exchanger 11 for recovering the heat released by an engine's exhaust, a fifth heat exchanger 12 for recovering the heat dissipated by the engine 1, an engine radiator 13, a pump P1, and 3-way valves.

A cold water/hot water circulation path includes an ice water side circulation path and a hot water side circulation path. The ice water side circulation path comprises a second water tank 15 and a second heat exchanger 5 which is disposed outdoors to perform the heat exchange between the coolant and water. The ice water side circulation path is chiefly used for generating ice water. The hot water side circulation path comprises a first water tank 14, a sixth heat exchanger 10 after dehumidification, a seventh heat exchanger 7 for defrosting, a first heat exchanger 3, the fifth heat exchanger 12, a solenoid valve S1, some 3-way valves, and a pump P2.

The above-mentioned functions performed by the multi-purpose engine-driven heat pump according to the present invention are further disclosed as follows:

A. house-cooling operation mode

Figure 2:
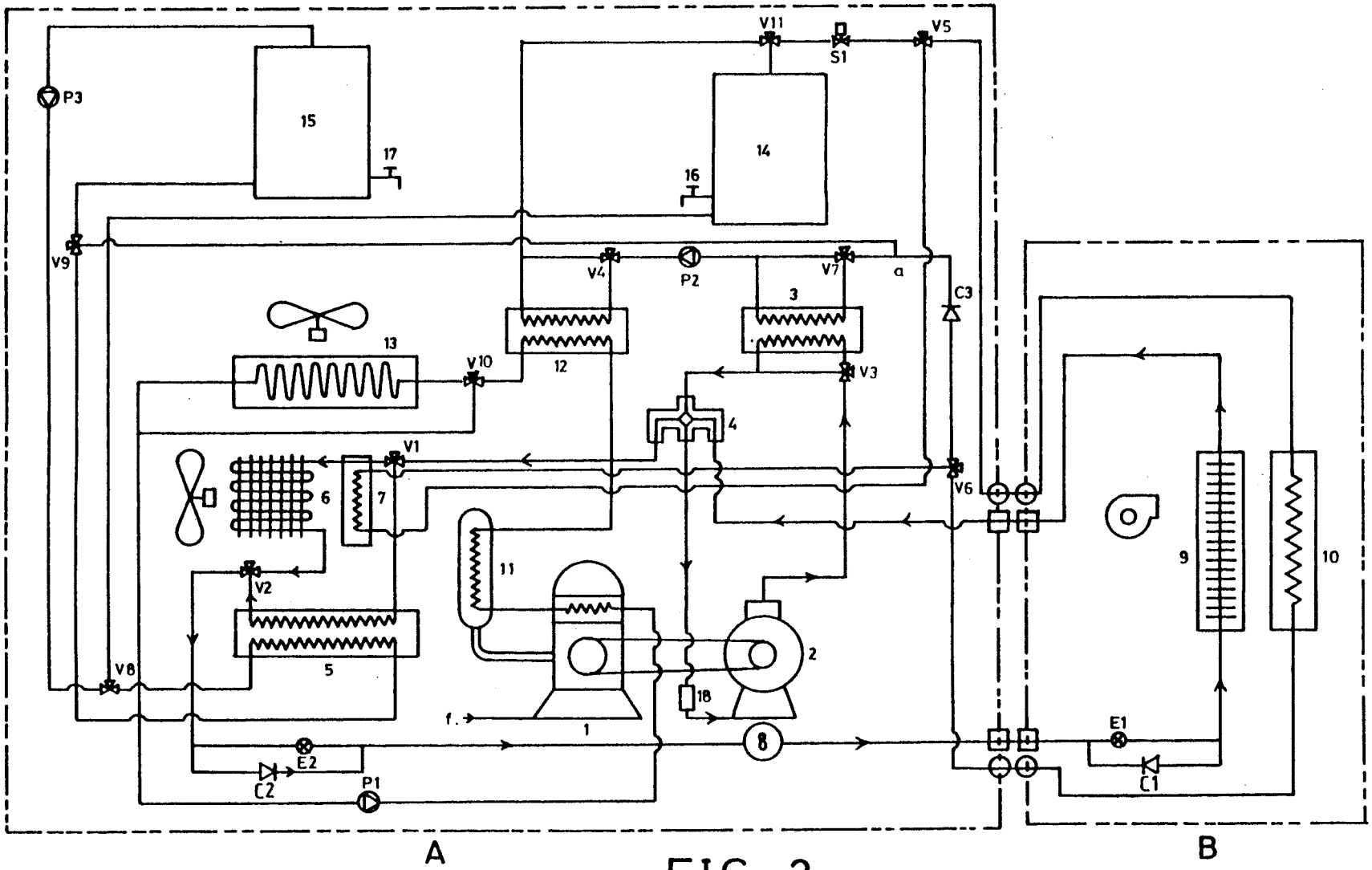
FIG. 2 is a schematic diagram of the multi-purpose engine-driven heat pump system operating in the house-cooling mode.

With reference to FIG. 2, during the house-cooling operation mode, the fourth heat exchanger 9 generates cold air and the second heat exchanger 5 or the third heat exchanger 6 generates hot water or discharges heat into the outdoor atmosphere. A first coolant cycle is as follows. The coolant is selectively delivered to the first heat exchanger 3 for recovering the heat dissipated by the heat pump or the four-way valve 4 through a third 3-way valve V3. Through the 4-way valve 4, the coolant is directed to the second heat exchanger 5 or the third heat exchanger 6. Because of the second heat exchanger 5, hot water is generated. Due to the third heat exchanger 6, the heat is discharged into the outdoor atmosphere. After the heat is released, the coolant returns to the coolant tank 8. Subsequently, by an expansion valve E1, the house-cooling effect takes place at the fourth heat exchanger 9. Finally, the coolant returns to the compressor 2 through the 4-way valve 4. Thus, the coolant cycle is completed.

b. house-heating operation mode

Figure 3:
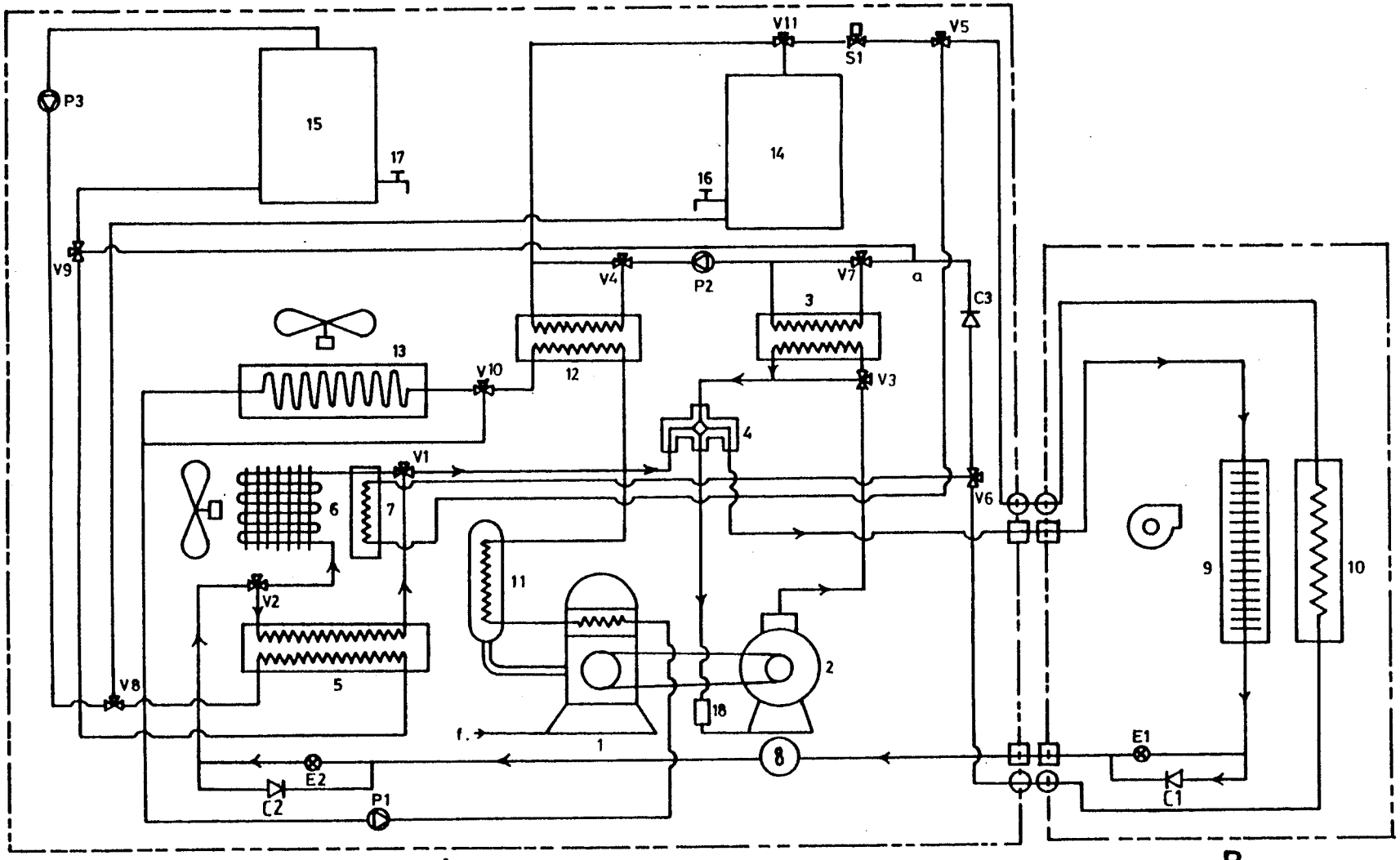
FIG. 3 is a schematic diagram of the multi-purpose engine-driven heat pump system operating in the house-heating mode.

With reference to FIG. 3 during the house-heating operation mode, the fourth heat exchanger 9 is used as a kind of radiator. Moreover, the major difference between the house-cooling operation mode and the house-heating operation mode is dominated by the 4-way valve which reverses the above-mentioned first coolant cycle. The reversal of the first coolant cycle is the second coolant cycle. The second coolant cycle is as follows. The coolant delivered by compressor 2 is controlled by a third 3-way valve V3. Then the coolant is directed by the 4-way valve 4 to the fourth heat exchanger 9 which has the house-heating effect. After passing through an expansion valve E2, the coolant is selectively directed by a second 3-way valve V2 to the second heat exchanger 5 or the third heat exchanger 6. Then, the coolant returns to the compressor 2 through the 4-way valve 4. Thus the house-heating cycle is completed.

c. dehumidifying operation mode

Figure 4:
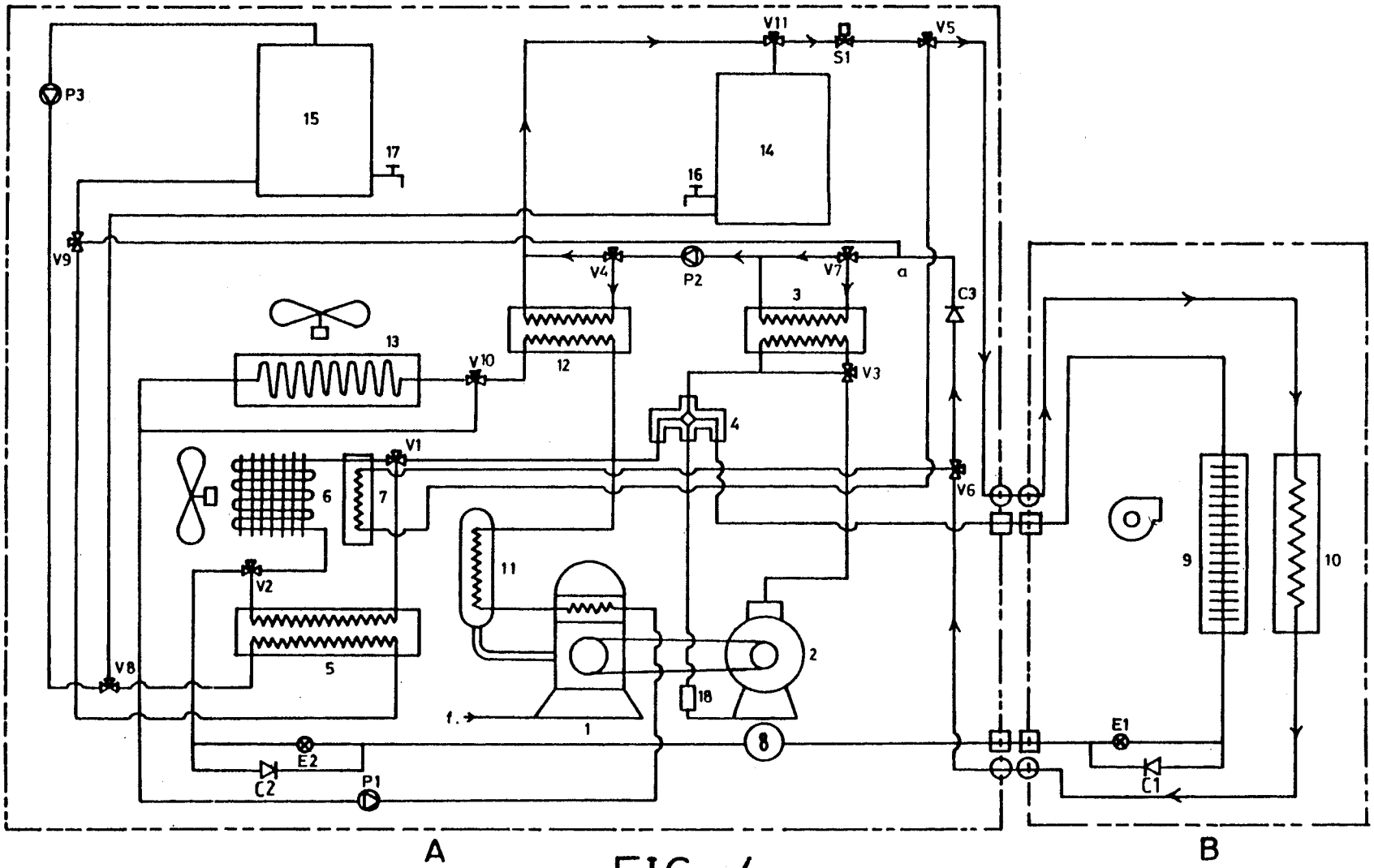
FIG. 4 is a schematic diagram of the multi-purpose engine-driven heat pump system operating in dehumidifying mode.

During dehumidifying operation mode, the coolant cycle is the same as that of house-cooling operation mode. However, during the dehumidifying operation mode, the moist air is cooled by the fourth heat exchanger 9. To keep the moist air at a constant temperature during it is being dehumidified, the sixth heat exchanger 10 after dehumidification is provided. With reference to FIG. 4, the fourth heat exchanger 10 after dehumidification utilizes the heat dissipated from the heat pump or the engine 1 to heat the dehumidified air. The cycle is as follows. With the solenoid valve S1 opened, the hot water in a first water tank 14 is directed by a fifth 3-way valve V5 to the sixth heat exchanger 10 after dehumidification. The coolant subsequently flows through a sixth 3-way valve V6 to the first heat exchanger 3 for recovering the heat dissipated by the heat pump, depending on if it is necessary to lead the water by a seven 3-way valve V7 to absorb the heat dissipated by the heat pump. Then, the water is selectively directed by a fourth 3-way valve V4 to the heat exchanger 12 for recovering the heat dissipated by the engine or directly to the first water tank 14, depending on if there is a need to absorb the heat, released from the engine's exhaust, which is controlled by a preset temperature of the engine's cooling water. The heated water is returned to the first water tank 14 to repeat the cycle.

d. defrosting operation mode

Figure 5:
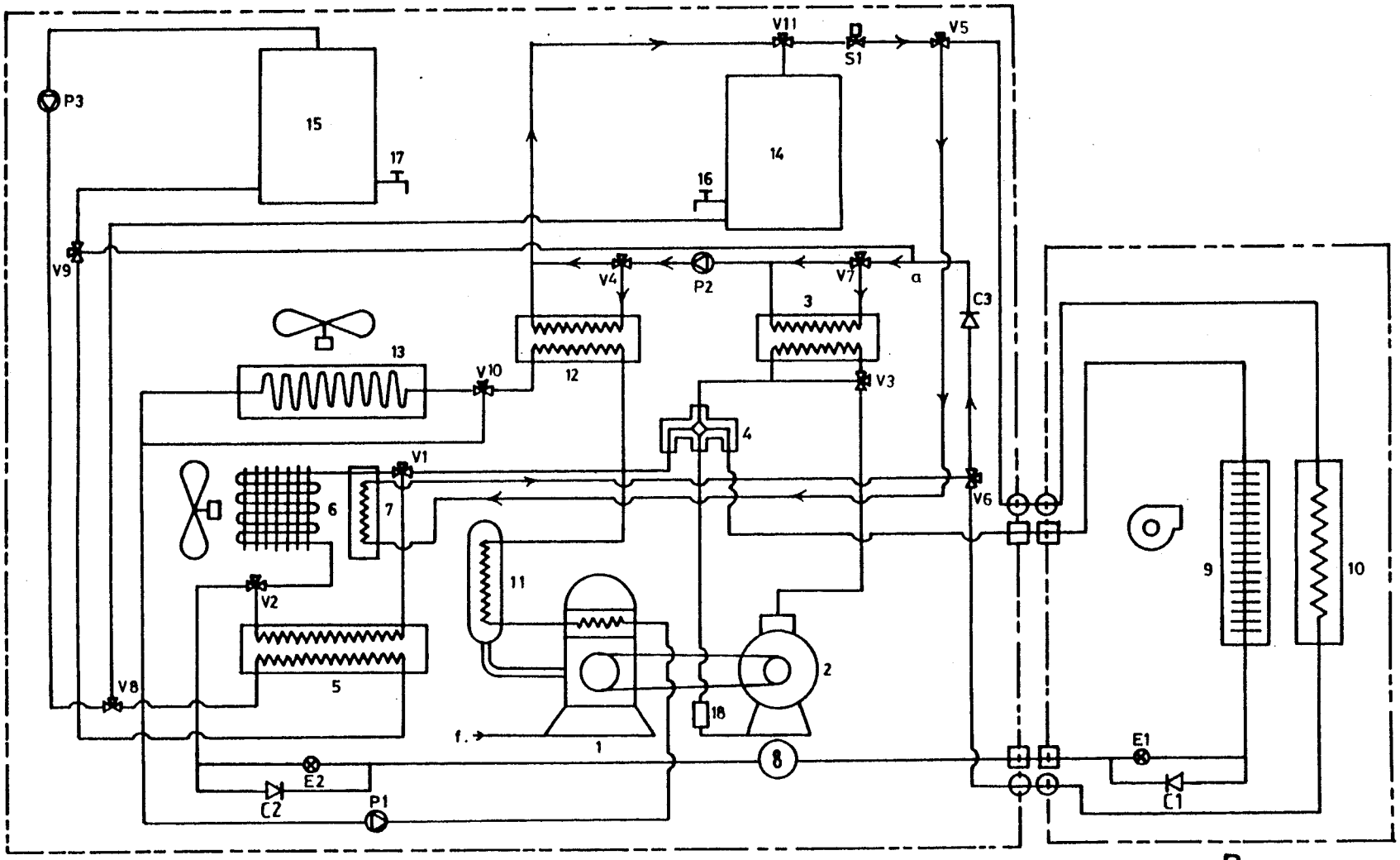
FIG. 5 is a schematic diagram of the multi-purpose engine-driven heat pump system operating in defrosting mode.

Frost developes during the house-heating operation mode. The frost forms on the copper tube or the fin of the third heat exchanger 6, since the temperature of the damp atmosphere is below the dew point. The frost is harmful to the third heat exchanger 6 which is disposed outdoors to perform the heat exchange between the coolant and air. Therefore, it must be removed. With reference to FIG. 5, the defrosting cycle is as follows. With the solenoid valve S1 opened, the hot water flows from the fifth heat exchanger 12 for recovering the heat dissipated by the engine or the hot water tank 14 directed by the fifth 3-way valve V5 to the seventh heat exchanger 7 for defrosting. The frost formed on the third heat exchanger 6 is removed by the heat dissipated from the seventh heat exchanger 7. The hot water passes through the sixth 3-way valve V6 and then the seventh 3-way valve V7 which can direct the hot water to the first heat exchanger 3 for recovering the heat dissipated by the heat pump. Then the hot water can selectively pass through the fifth heat exchanger 12 for recovering the heat dissipated by the engine 1 or directly to the first water tank 14.

e. hot water generating operation mode

Figure 6:
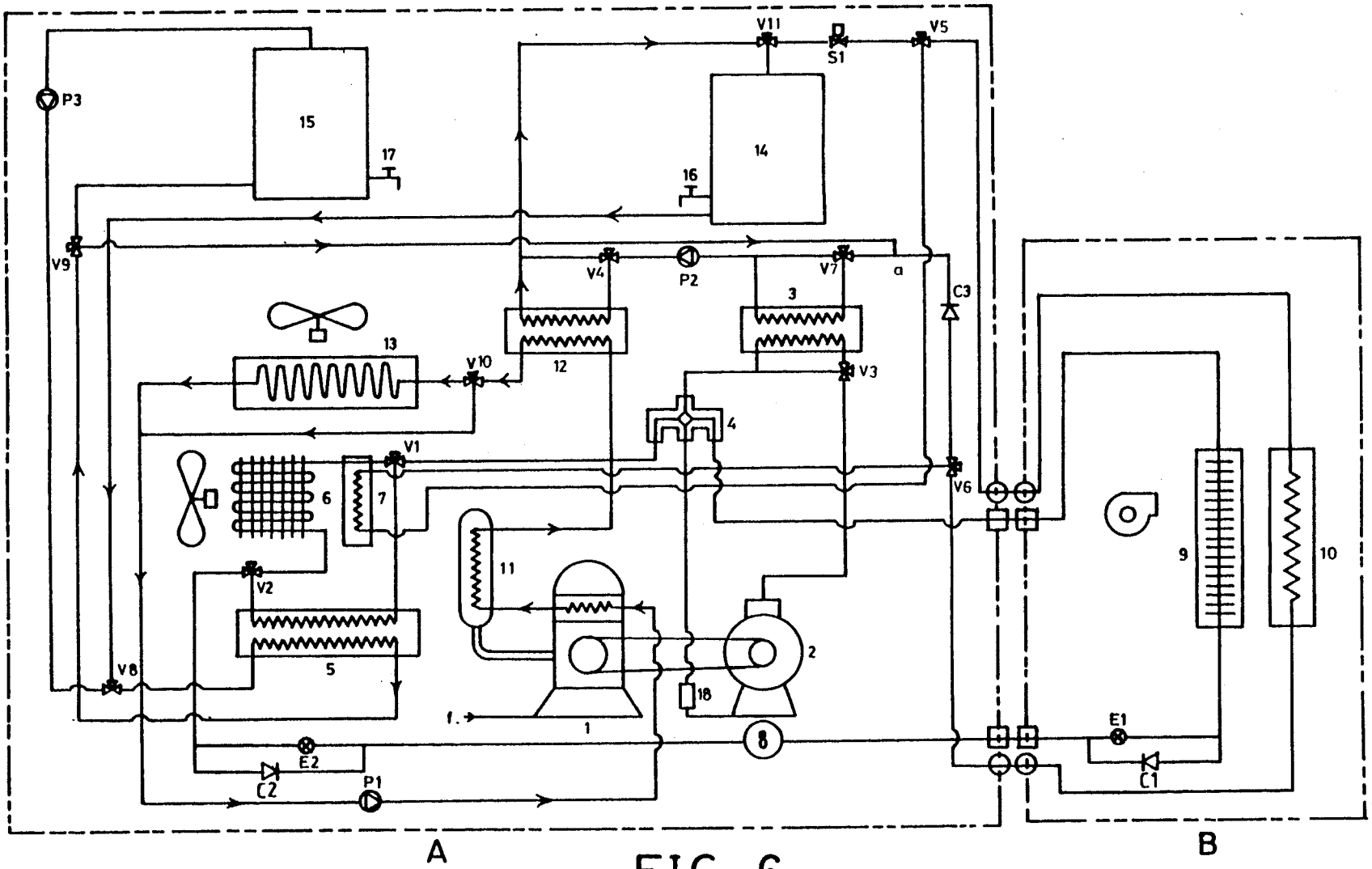
FIG. 6 is a schematic diagram of the multi-purpose engine-driven heat pump system operating in hot water generating mode.

There are two sources for hot water. One is the heat from the heat pump. The other is from the engine. With reference to FIG. 6, The heat comes from the first heat exchanger 3 for recovering the heat dissipated by the heat pump P2 and the second heat exchanger 5 form the heat pump P1. The heat from the fifth heat exchanger 12 for recovering the heat dissipated by the engine 1 comes from the engine 1. The sum of the heat from the first heat exchanger 3 for recovering the heat dissipated by the heat pump P2 and the heat from the second heat exchanger 5 is equal to the heat dissipated by the heat pumps P1 and P2. Moreover, the heat pumps operate in the house-cooling operation mode.

The circulation path on the hot water side can selectively include the first heat exchanger 3 for recovering the heat dissipated by the heat pump P2. The circulation path is as follows. The water of lower temperature flows from the first water 14 tank at the bottom of it. Through an eighth 3-way valve V8, the water flows to the second heat exchanger 5. After passing a ninth 3-way valve V9, the water arrives at point 'a' where the water is diverted to the seven 3-way valve V7. If there is a need to increase the temperature of the water, the seventh 3-way valve V7 is able to direct the water to the first heat exchanger 3 for recovering the heat dissipated by the heat pump P2. After the temperature of the water is increased once, if necessary, the water is able to be directed by the fourth 3-way valve V4 to the fifth heat exchanger 12 for recovering the heat dissipated by the engine 1 to increase the temperature of the water once more. If the temperature of the water at the fourth 3-way valve V4 reaches a desired level, there is no need to direct the water to the fifth heat exchanger 12 for recovering the heat dissipated by the engine 1. If the water is overheated by the fifth heat exchanger 12 for recovering the heat dissipated by the engine 1, a tenth 3-way valve V10 directs the overheated water to the engine radiator 13 to dissipate the heat.

f. ice-water generating operation mode

Figure 7:
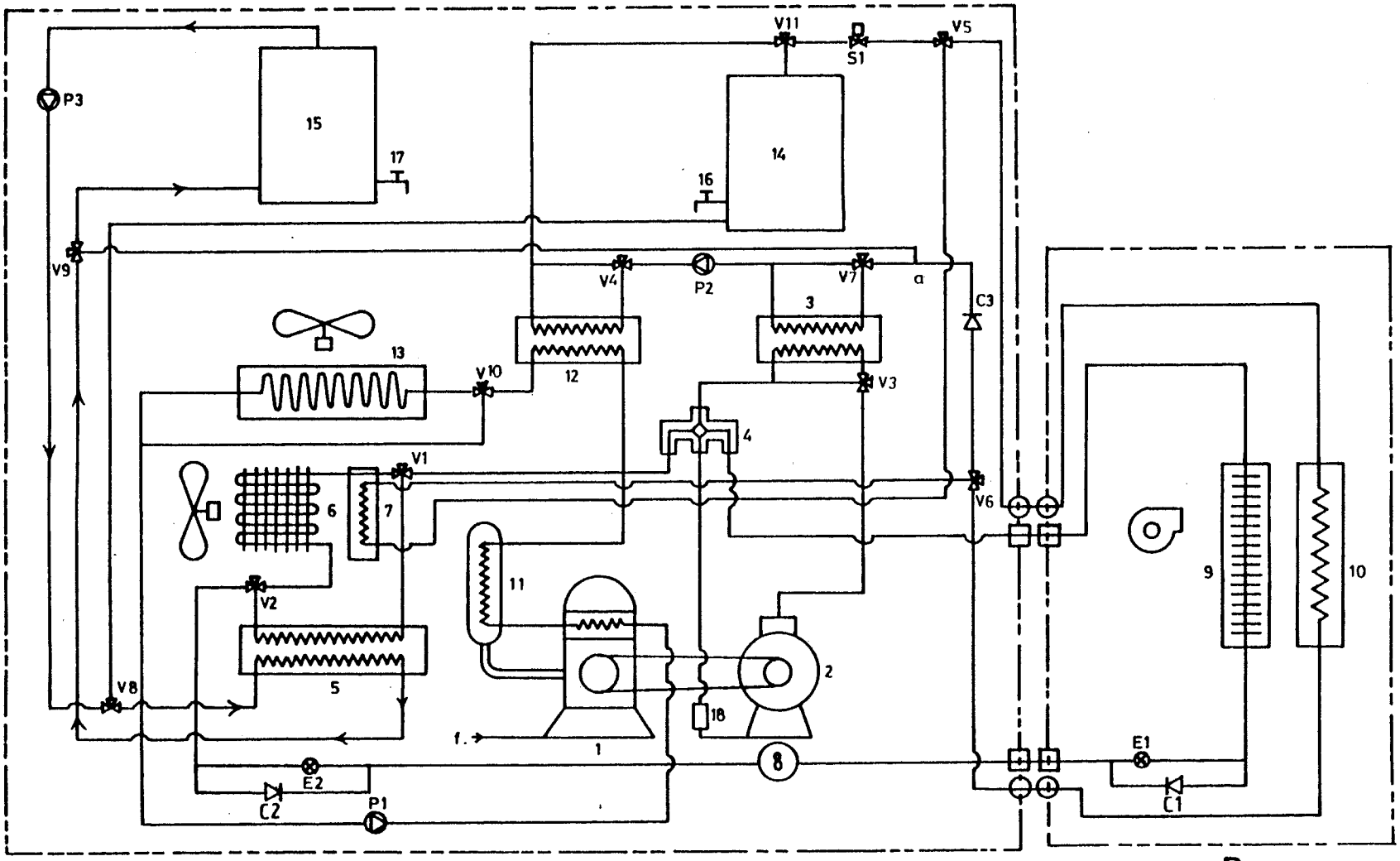
FIG. 7 is a schematic diagram of the multi-purpose engine-driven heat pump system operating in ice water generating mode.

The ice-water generating process is similar to the hot water generating process except that the heat pump is during the house-heating operation mode. Certainly, the hot water is generated also. With reference to FIG. 7, the coolant has a cooling effect at the second heat exchanger 5. The water from a second water tank 15 is directed by the eighth 3-way valve V8 to the second heat exchanger 5 to generate the ice water. By the ninth 3-way valve V9, the ice water returns to the second water tank 15. During this mode, the sum of the heat from the first heat exchanger 3 for recovering the heat dissipated by the heat pump P2 and the heat from the fourth heat exchanger 9 is equal to the total heat dissipated from the heat pumps.

Summing up the above operation mode, the multi-purpose engine-driven heat pump system is able to has any one of the following functions:

a. the house-cooling function only;

b. a combination of the house-cooling function and the hot water generating function;

c. the house-heating function only;

d. a combination of the house-heating function and the hot water generating function;

e. a combination of the house-heating function and the ice water generating function;

f. the defumidifying function only;

g. a combination of the dehumidifying function and the hot water generating function;

h. the defrosting function only;

i. a combination of the ice water generating function and the hot water generating function.

While the invention has been described by way of examples and in terms of several preferred embodiments, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A multi-purpose engine-driven heat pump system which uses a solenoid valve, an expansion valve, 3-way valves and a 4-way valve to control the circulation path of coolant and water to perform various air-conditioning functions including house-cooling, house-heating, and dehumidifying, which comprises:

(a) a first heat exchanger, which is disposed outdoors and capable of absorbing the heat dissipated from a heat pump;

(b) a second heat exchanger, which is disposed outdoors and connected to the first heat exchanger by way of a first 3-way valve, being capable of performing a heat exchange between the water and the coolant;

(c) a third heat exchanger, which is disposed outdoors and connected also to the first heat exchanger by way of the first 3-way valve, being capable of performing a heat exchange between the coolant and outdoor atmosphere;

(d) a coolant tank, which is connected to the second heat exchanger and the third heat exchanger by way of a second 3-way valve;

(e) a fourth heat exchanger, which is disposed indoors and connected to the coolant tank through the expansion valve; and (f) a compressor, which is connected to the first heat exchanger by way of a third 3-way valve, to the second heat exchanger and the third heat exchanger by way of the 4-way valve with the 4-way valve between the first 3-way valve and the compressor, and to the fourth heat exchanger by way of the 4-way valve, the coolant being circulated in the sequential order of the compressor, the first heat exchanger, the second heat exchanger or the third heat exchanger, the coolant tank, and the fourth heat exchanger whereby the house-cooling function and the dehumidifying function are performed at the fourth heat exchanger, and whereby, with the circulation order reversed between the 4-way valve and the fourth heat exchanger, the house-heating function is also performed at the fourth heat exchanger.

2. A multi-purpose engine-driven heat pump system as claimed in claim 1, wherein the first heat exchanger is simultaneously operated, during the house-cooling operation, with a temperature-regulating system which comprises:

(a) a fifth heat exchanger, which is connected in series to the first heat exchanger by way of a fourth 3-way valve;

(b) a first water tank, which is connected to the fifth heat exchanger, whereby the first water tank contains the hot water generated by the first heat exchanger and the fifth heat exchanger;

(c) a sixth heat exchanger, which is disposed proximate the fourth heat exchanger and connected to the hot water tank by way of the solenoid valve and a fifth 3-way valve and connected to the first heat exchanger by way of a sixth 3-way valve and a seventh 3-way valve whereby the temperature of the dehumidified indoor moist air is kept constant by the sixth heat exchanger.

3. A multi-purpose engine-driven heat pump system as claimed in claim 1, wherein the first heat exchanger is simultaneously operated, during the house-heating operation, with a defrosting system which comprises:

(a) a first water tank which is connected to the first heat exchanger by way of the fourth 3-way valve and contains hot water generated by the first heat exchanger;

(b) a seventh heat exchanger, which is disposed beside the third heat exchanger, is connected to the first water tank by way of a fifth 3-way valve, and is connected to the first heat exchanger by way of a sixth 3-way valve and a seventh 3-way valve whereby the seventh heat exchanger is able to remove the frost formed on the third heat exchanger.

4. A multi-purpose engine-driven heat pump system as claimed in claim 3, wherein the water is directed by the seventh 3-way valve to the first water tank and selectively directed by the fourth 3-way valve to the fifth heat exchanger which receives heat from the engine driving said heat pump system, whereby the temperature of the hot water is further increased by the fifth heat exchanger.

5. A multi-purpose engine-driven heat pump system as claimed in claim 2, wherein an eighth 3-way valve is provided to create a path between the first water tank and the second heat exchanger and a ninth 3-way valve is also provided to create a path between the second heat exchanger and the first heat exchanger whereby the hot water is generated only by the first heat exchanger and directed to the first water tank directly by way of the fourth 3-way valve.

6. A multi-purpose engine-driven heat pump system as in claimed in claim 5, wherein the hot water is further directed by the fourth 3-way valve to the fifth heat exchanger which receives heat from the engine driving the heat pump system, and then to the first water tank whereby the temperature of the hot water is further increased.

7. A multi-purpose engine-driven heat exchanger system as claimed in claim 1, wherein a second water tank is provided to the second heat exchanger through an eighth 3-way valve in the water flow path from the second water tank to the second heat exchanger and a ninth 3-way valve in the water flow path from the second heat exchanger to the second water tank whereby the ice water is generated by the second heat exchanger during the house-heating operation.

8. A multi-purpose engine-driven heat exchanger system as claimed in claim 1, wherein the engine driving the heat pump system is operable by a non-electric power source.

9. A multi-purpose engine-driven heat exchanger system as claimed in claim 8, the non-electric power source is gas.

* * * * *